United States Patent [19]

Page, Jr.

Best Available Copy

[11] 4,085,804

[45] Apr. 25, 1978

[54] WELL TUBING ANCHOR WITH AUTOMATIC SLIP RELEASE

[76] Inventor: John S. Page, Jr., 10424 Echo River Ct., Fountain Valley, Calif. 92708

[21] Appl. No.: 718,916

[22] Filed: Aug. 30, 1976

Related U.S. Application Data

[63] Continuation-in-part of Ser. No. 595,561, Jul. 14, 1975, Pat. No. 3,977,473.

[51] Int. Cl.[2] ..... E21B 23/04; E21B 40/00

[52] U.S. Cl. ..... 166/315; 166/212; 166/217

[58] Field of Search ..... 166/212, 217, 120, 315

[56] References Cited

U.S. PATENT DOCUMENTS

| | | | |
|---|---|---|---|
| 2,687,778 | 8/1954 | Dunn | 166/212 |
| 2,818,926 | 1/1958 | Webb | 166/212 |
| 2,823,754 | 2/1958 | Ault | 166/212 X |
| 3,211,227 | 10/1965 | Mott | 166/120 |
| 3,374,837 | 3/1968 | Page et al. | 166/120 |
| 3,468,258 | 9/1969 | Arutunoff | 166/212 X |
| 3,608,634 | 9/1971 | Cochran | 166/212 X |
| 3,976,133 | 8/1976 | Allen | 166/120 |

*Primary Examiner*—Stephen J. Novosad
*Attorney, Agent, or Firm*—William W. Haefliger

[57] ABSTRACT

A well tubing anchor incorporates means to suddenly unblock movement of slips relative to a wedge surface upon predetermined build-up of well fluid pressure exerted on a piston or pistons that urge the slips axially.

14 Claims, 8 Drawing Figures

WELL TUBING ANCHOR WITH AUTOMATIC SLIP RELEASE

BACKGROUND OF THE INVENTION

This application is a continuation-in-part of my earlier application Ser. No. 595,561, filed July 14, 1975, now U.S. Pat. No. 3,977,473.

This invention relates generally to well tubing anchors, and more particularly concerns an anchor and its method of use which overcome many problems characteristic of known anchors.

Two types of tubing anchors are commonly in use today. One has a slip-cone wedging engagement with well casing that provides the stability in the casing. This type requires tubing rotation to set it and accurate well data to make calculations so that the correct amount of tension can be pulled into the tubing. In order to land the tubing in tension, a special threaded tensioning device is required at the top of the tubing. Also, to release the anchor, the tubing must be rotated to the right. Experience shows that such anchors are sometimes very difficult to loosen from the casing.

The other type of anchor is an hydraulic tool utilizing a piston that pushes a shoe radially outwardly against the casing. While this type anchor sets automatically without any tubing manipulation, it does not provide the stability in the casing that the slip-cone type anchor provides. For example, it often undergoes a slight movement that causes the seal or packer to fail in heavy pumping wells. Also, this type anchor sets prior to tubing elongation that tends to buckle the tubing above the anchor.

SUMMARY OF THE INVENTION

It is a major object of the present invention to provide an anchor that incorporates the advantages of the above referenced prior anchors while eliminating disadvantages of each. Basically, the invention is embodied in an anchor that comprises:

a. a tubular body connectible in series with a well tubing string, there being a wedge surface on the body and tapering axially, b. slip means movable axially relative to the body and positioned to be urged relatively radially outwardly toward the casing by the wedge surface, c. piston means carried for axial movement relative to the body, and having piston surface extent exposed to well fluid pressure acting to urge the piston means and slip means axially, and d. delay means acting to block said movement of the slip means relative to the body while well fluid pressure exerted on the piston surface extent remains below a predetermined level, and to unblock such relative movement when the well fluid pressure reaches said level whereby the pressure is then operable to effect axial movement of the slip means.

As will be seen, the delay means typically comprises a first part carried for axial movement with the piston means, and a second part carried by the body to block such axial movement, one of such parts being displaceable out of blocking position relative to the other part in response to force transmission between the parts when well fluid pressure reaches the predetermined level. In one form, the one part may comprise a cantilever mounted arm, which may include adjustable leaf spring means and a backer, and in another form the one part may comprise a shearable element such as a shear pin; also these two type parts may be used in conjunction, as will be seen.

The invention also concerns the provision of a configuration that includes a carrier ring extending about the body at one end of the slips to push them axially, the piston means extending axially endwise in the body, and there being structure to transmit force from the piston means to the ring, such structure including a rod or rods extending axially in the body.

A further aspect of the invention comprises the provision of a carrier sleeve extending about the body and defining a window which receives at least part of a slip.

The invention avoid or minimizes the problem of buckling of the tubing above the anchor where the anchor is set prior to tubing elongation, and the tubing subsequently elongates. Also, setting of the anchor is automatic and stable, it does not require tubing manipulation, and it takes place only after predetermined stretch of the tubing by fluid weight transmitted to the tubing during pumping.

These and other objects and advantages of the invention, as well as the details of an illustrative embodiment, will be more fully understood from the following description and drawings, in which:

DRAWING DESCRIPTION

DETAILED DESCRIPTION

Figure 1:
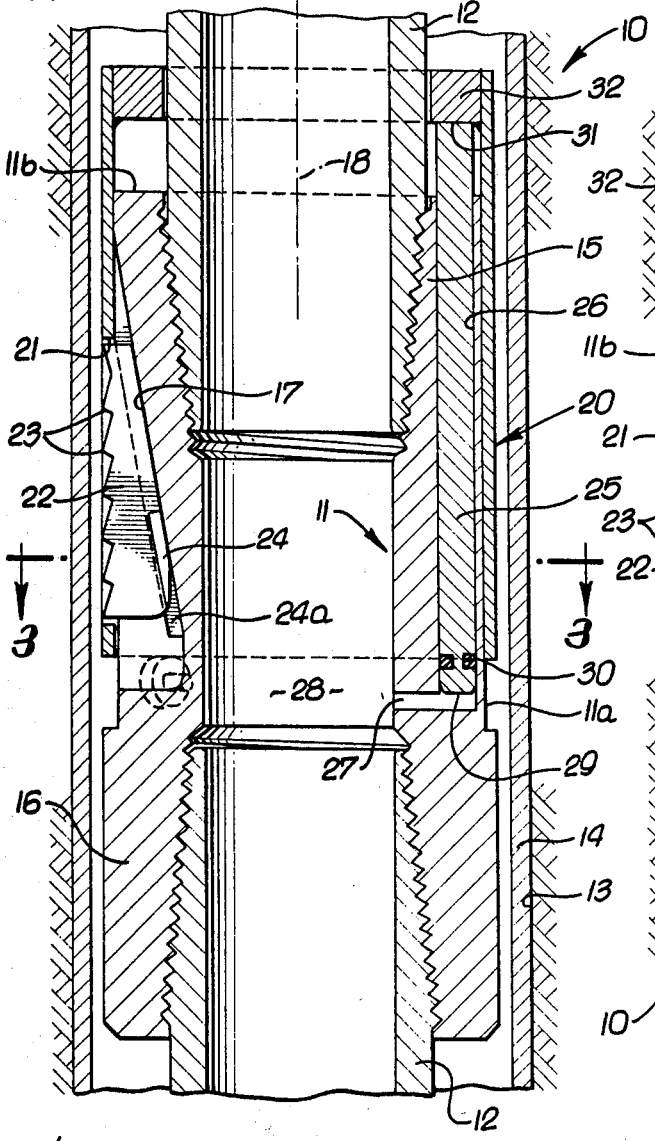
FIG. 1 is an elevation taken in section through a tubing anchor embodying the invention.
Figure 2:
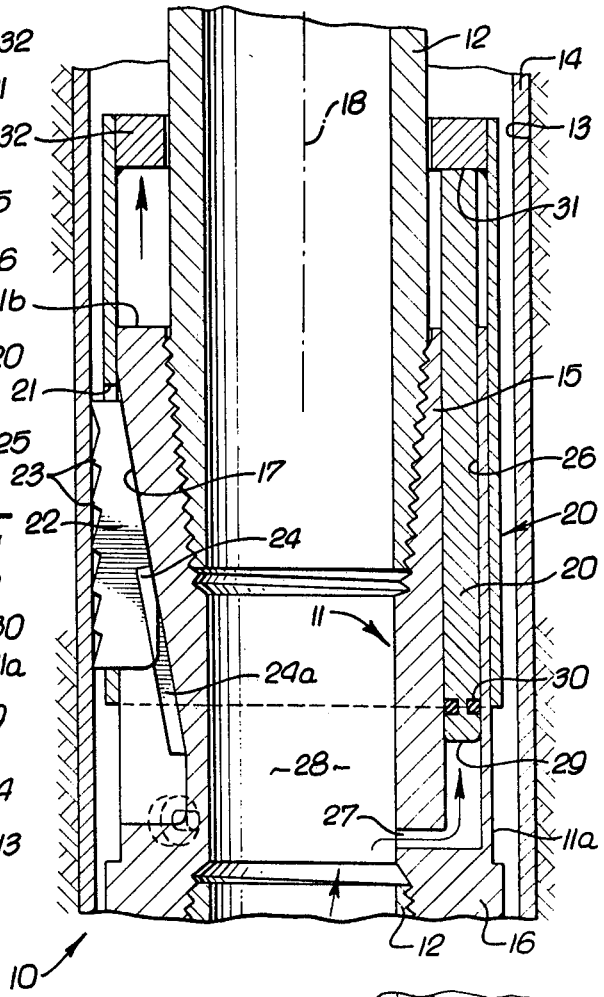
FIG. 2 is a view like FIG. 1, but showing the anchor in actuated condition.

The tool 10 shown in the drawings includes a tubular body 11 connected in series with tubing 12 in a string. The latter is located in a well 13 cased at 14. The body 11 includes threaded box members 15 and 16 at its opposite ends into which threaded pin members at the ends of the tubing are connected. At least one, and preferably three wedge surfaces 17 are provided on the body to taper axially. In the illustrated embodiment, the wedge surface or surfaces define a cone tapering downwardly, the body being oriented upright and having a vertical axis 18 which is coincident with the cone axis.

The apparatus also includes slip means and a carrier therefor movable axially relative to the body, so that the slip means is urged relatively radially outwardly toward the casing by the wedge or cone surface, during slip means relative axial movement. In the illustrated example, the carrier comprises a sleeve 20 extending about and slidable axially lengthwise on the tubular body outer surface 11*a*. The tubular sleeve defines three side windows 21 spaced about axis 18 to receive three slips 22 having jaws or serrations 23 facing downwardly to engage the casing bore. The slips are formed to have T-shaped horizontal cross sections to define bosses or ears 24 fitting in T-shaped slots 24*a* milled in the body 11, whereby the slips are loosely retained to the body as they are moved up and down with and by the sleeve, and along tapered wedge or cone surfaces 17.

The apparatus incorporates piston means carried for axial movement relative to the tubular body 11, such piston means being operatively connected with the carrier or sleeve 20 and having piston surface extent exposed to well fluid pressure acting to urge the piston means, carrier and slips axially to set the slips. In the illustrated embodiment, the piston means includes multiple pistons 25 which are axially elongated and spaced at equal angles about the body axis within axial bores 26 in the body. Ports 27 communicate between a vertical through passage 28 in the body and the piston surface extent, i.e. piston surfaces 29 at the lower ends of the pistons, whereby well fluid pressure on the tubing tends to elevate the pistons in the body. Annular seals 30 on the pistons seals off between the pistons and the bores 26. The upper ends of the pistons are connected at 31 to an annulus 32 extending directly above the upper end **11*b* of the body and integral with carrier sleeve 20**, so that the carrier and slips are elevated as the pistons move up.

Figure 3:
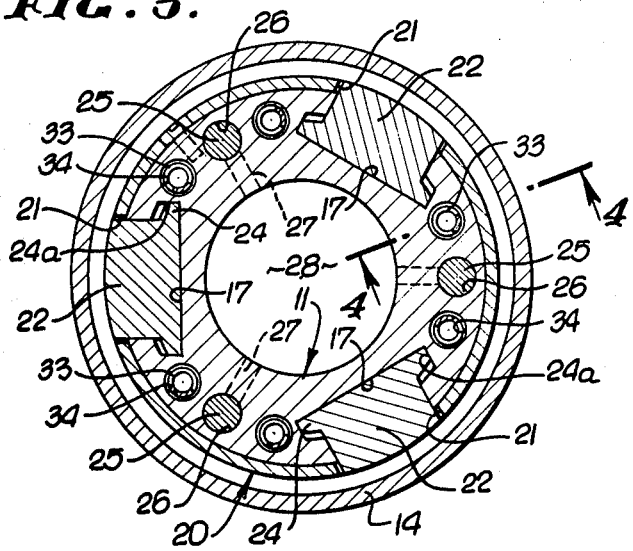
FIG. 3 is a horizontal section taken on lines 3—3 of FIG. 1.

In accordance with an important feature of the invention, delay means is provided to transmit force acting to delay axial movement of the carrier and slips by the pistons and relative to the body until predetermined well fluid pressure is exerted on the piston surface or surfaces 29. Typically, such delay means may comprise spring means carried by the body, as for example at least one and preferably multiple tension springs 33 extending axially within body axial openings 34 spaced circularly relative to the piston bores 26. Note that one bore 26 and two spring openings 34 are shown in FIG. 3 in the space between successive slips, whereby the assembly is very compact in design, enabling foreshortening of body axial length. The number of springs employed or used in the openings 34 is selected to match, approximately, the delay force to be achieved and resisting upward displacement of the pistons by fluid pressure, whereby the fluid pressure required to set to slips can be pre-selected in a very simple and efficient manner.

Figure 4:
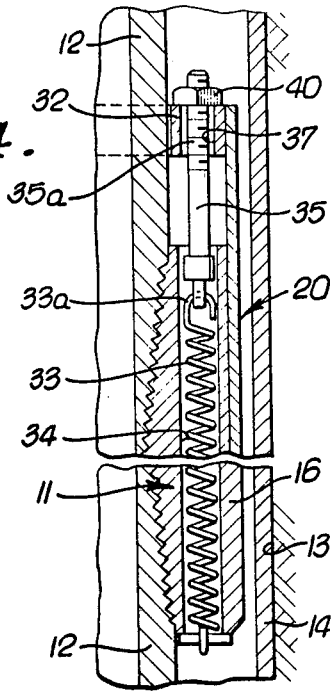
FIG. 4 is a vertical section on lines 4—4 of FIG. 3.
Figure 5:
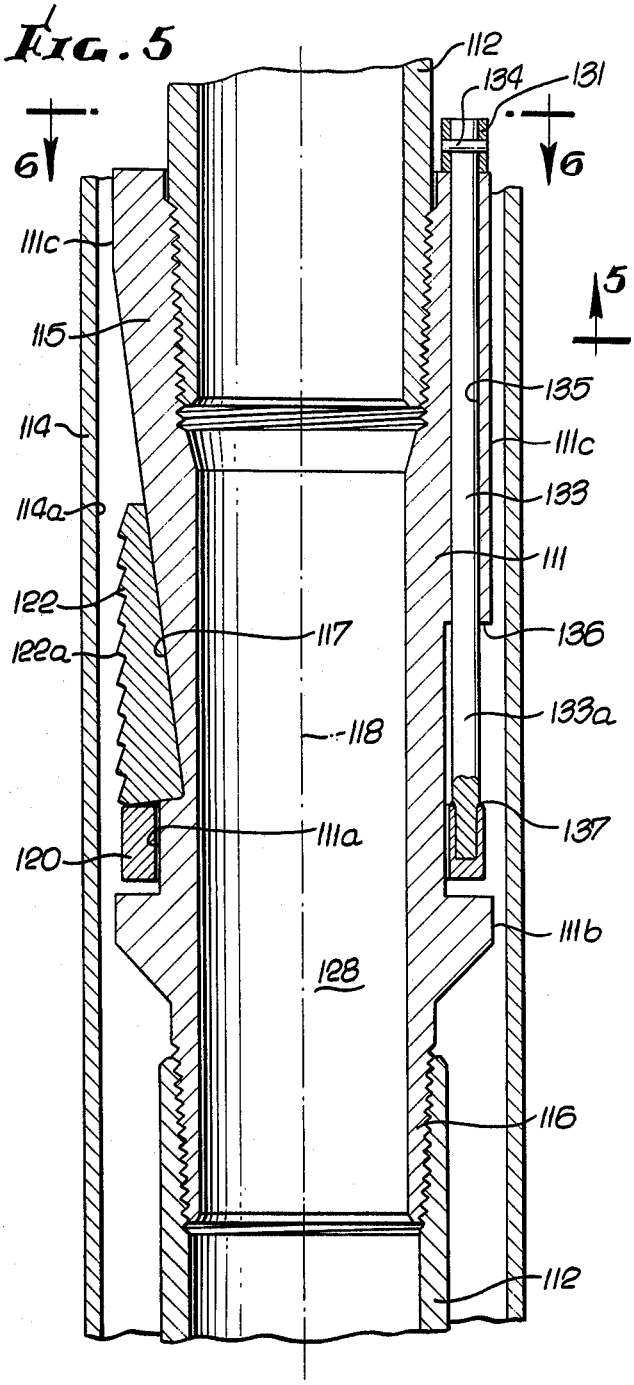
FIG. 5 is an elevation taken in section through a modified tubing anchor embodying the invention.

Also, the tension of the springs employed can be carried as by the adjusting means shown in FIG. 4. As illustrated, the upper ends **33*a* of the springs are attached to axial fasteners 35, and the latter may be moved up or down relative to the ring 32 as by rotation of a nut 40 on the threaded upper end 35*a* of each fastener projecting upwardly through an opening 37 in the ring 32**. This may of course be done prior to running of the anchor and tubing in the well.

In operation, the springs 33 urge the sleeve 20 downwardly, the sleeve in turn urging the slips downward to FIG. 1 position prior to setting of the anchor. The slips are urged radially inwardly by the walls of the downwardly tapered slots **24*a* in the body. After a delay interval corresponding to well pressure rise to predetermined level, the upward force communicated to the pistons overcomes the downward spring force, and the pistons displace the sleeve 20 upwardly, the slips thereby being displaced upwardly and cammend outwardly by wedge surfaces 17** to engage and anchor to the casing. This anchors the tubing to the casing, without requiring any surfaces manipulation of the tubing. Further, the anchor may be forcibly pulled or dragged out of the well with sufficient upward force applied to the tubing, without requiring prior tubing rotation.

Due to the angularity and downward inclination of the teeth 23, any attempted elongation of the tubing, after initial setting of the anchor, will act to further drive the teeth into the casing, to finally set the anchor.

Referring to FIGS. 5–8, a tubular body 111 is connected in series with tubing sections 112 in a string. The body includes internally threaded box member 115 and the externally threaded pin member 116 at body opposite ends and to which the tubing sections are connected. Body wedge surfaces 117 taper downwardly, relative to vertical body axis 118.

Slip means and a carrier therefor are movable axially relative to the body, so that the slip means is urged relatively radially outwardly toward the casing by the wedge surface or surfaces. The carrier is shown to include an annular ring 120 loosely extending about the body reduced diameter surface portion **111*a*, the ring being slidable axially lengthwise on or adjacent surface portion 111*a*. Note that the ring is within a vertical cylinder defined by the body maximum diameter surfaces 111*b* and 111*c*. The slip means typically include three like slips 122 spaced at 120° intervals about axis 118. The slips may have T-shaped horizontal cross sections to define bosses or ears fitting in T-shaped slots milled in the body, as explained in FIG. 1, whereby the slips are loosely retained to the body as they move up and down and along tapered wedge or cone surfaces 117. Note the jaws or teeth 122*a* at the slip outer surfaces, angled to engage and grip the bore 114*a* of casing 114**.

The apparatus includes piston means carried for axial movement relative to the body, the piston means operating the carrier or ring 120; also, the piston means has piston surface extent exposed to well static fluid pressure acting to urge the piston means, carrier and slip means axially upwardly. Such piston means may typically and advantageously include a single piston 125 which is axially elongated and movable within axial bore 126 in the body. Port 127 communicates between a vertical through passage 128 in the body and the piston lower surface extent as for example as defined at **129*a* by a piston seal 129. An additional seal appears at 130**.

Structure is provided to transmit force from the piston to the carrier ring 120. Such structure is shown to include a head 131 at the upper end of the body and suitably engaging the piston; also such structure includes a connecting rod 133 pin-connected to the head 134 and extending downwardly within a body bore 135. The lower extent **133*a* of the rod projects free of the body, i.e. below body shoulder 136, but within the cylinder defined by the body surface 111*c*, for connection to the ring 120, as at 137. Accordingly, as the piston is urged up, the rod 133 and ring 120** also move up.

In accordance with an important feature of the invention, delay means is provided to block upward movement of the carrier ring and slips relative to the body while well fluid pressure exerted on the piston remains below a predetermined value; however, such delay means is operable to suddenly unblock such relative movement, allowing the slips to be moved suddenly upwardly, when the well fluid pressure reaches the predetermined level. Accordingly, fluid pressure is then fully operable to effect sudden movement of the slips upwardly and outwardly to grip the casing. Therefore, the tubing is allowed to stretch due to the applied weight of fluid pumped upwardly in the tubing, and positive anchoring is only effected after such stretching, i.e. after sufficient well fluid is pumped up into the tubing to overcome the blockage of the delay means.

Figure 6:
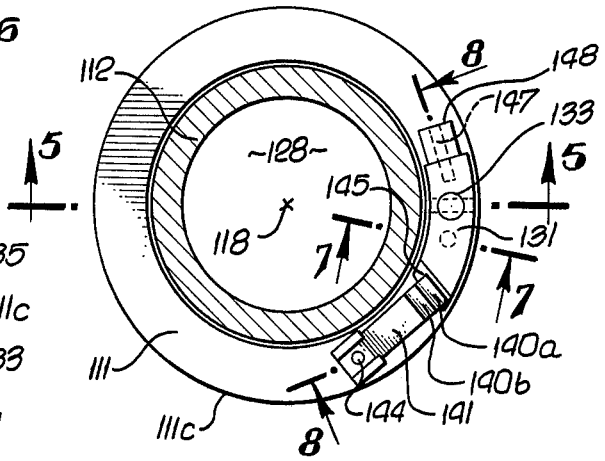
FIG. 6 is horizontal section on lines 6—6 of FIG. 5.
Figure 7:
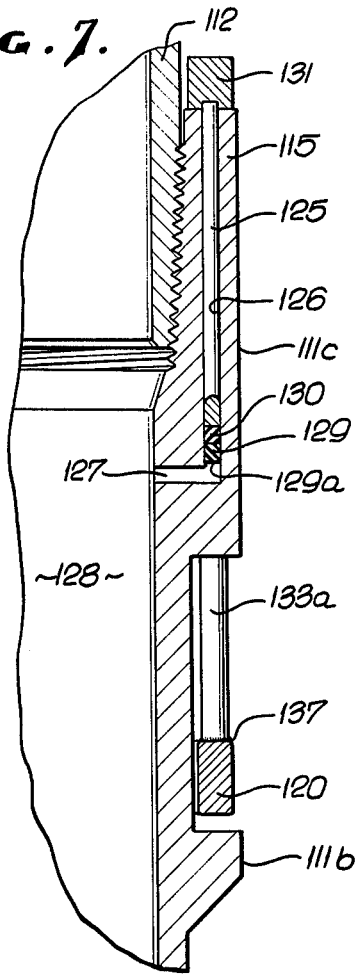
FIG. 7 is a fragmentary elevation taken in section on lines 7—7 of FIG. 6.
Figure 8:
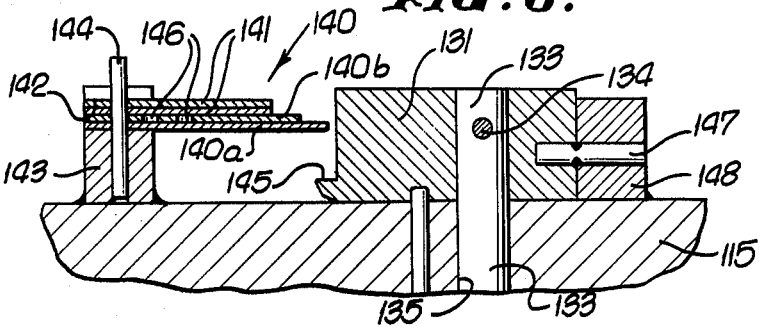
FIG. 8 is an enlarged fragmentary section taken in elevation on lines 8—8 of FIG. 6.

More specifically, the delay means may comprise a first part carried by the carrier ring, as at the top of rod 133, for axial movement therewith, and a second part carried by the body 115 to block such axial movement, one of the parts being displaceable out of blocking position relative to the other part in response to force transmission between the two parts when the well fluid pressure reaches predetermined level. As shown in FIGS. 6 and 8, such one part may advantageously comprise a cantilevered arm, including adjustable leaf spring means 140 including flat springs **140*a* and 140*b* and a backer or backers 141. Note that the springs and backer project laterally and freely form a recess 142 defined by a block 143 attached to the upper end of body 111. A pin 144 retains the arms elements in position, as shown, and may be removed to allow lateral shifting of upper spring 140*b* for example to alter the cantilever spring blocking resistance presented to shoulder 145 on part or head 131 (i.e. to alter the threshold at which fluid pressure exerted upwardly on the piston overcomes the spring resistance, to effect sudden release of shoulder 145 and upward travel to suddenly actuate the slips). Holes may be formed at 146 in the spring 140*b* to permit reception of pin 144** after the spring is shifted laterally. Also, the backer may be shifted laterally, or different length backers can be used, to alter the resistance of bending.

An alternate or additional delay means comprises a shearable element interconnecting the carrier and body. For example, a shear pin 147 may be located at the upper end of the body, to laterally interconnect head 131 and a block 148 attached to the body 115. With the pin in place, the force threshold at which shear takes place, as created by fluid pressure acting on the piston, is the determining factor as to when sudden slip actuation takes place. When the pin is removed, the leaf spring means provides the suddenly releasable blockage to slip activation. Accordingly, the user may adjust or set the predetermined level of fluid pressure at which the slips are anchored.

Different strength shear pins can be used to adjustably vary the resistance to unblocking.

I claim:

1. In apparatus to anchor well tubing to well casing, a. an upright tubular body connectible in series with a well tubing string, there being a wedge surface on the body and tapering axially, b. slip means movable axially relative to the body and positioned to be urged relatively radially outwardly toward the casing by the wedge surface, c. piston means carried for axial movement relative to the body, and having piston surface extent exposed to well fluid pressure acting to urge the piston means, and slip means axially as aforesaid, and d. delay means on the body acting to block said movement of the slip means relative to the body while well fluid pressure exerted on said piston surface extent remains below a predetermined level, and to unblock said relative movement when the well fluid pressure reaches said level whereby the pressure is then operable to effect axial movement of the slip means, e. there being structure including a rod extending axially of the body to transmit force from the piston means to the slip means.

2. The apparatus of claim 1 wherein said delay means comprises a first part carried for movement with the piston means, and a second part carried by the body to block said axial movement, one of said parts being displaceable out of blocking position relative to the other part in response to force transmission between said parts when said pressure reaches said level.

3. The apparatus of claim 1 wherein said delay means includes a shearable element.

4. The apparatus of claim 3 wherein said shearable element comprises a shear pin located on the body and toward which the slip means is movable.

5. The combination of claim 1 wherein said structure includes a carrier for the slip means, said carrier including a ring extending about the body.

6. In apparatus to anchor well tubing to well casing, a. a tubular body connectible in series with a well tubing string, there being a wedge surface on the body and tapering axially, b. slip means movable axially relative to the body and positioned to be urged relatively radially outwardly toward the casing by the wedge surface, c. piston means carried for axial movement relative to the body, and having piston surface extent exposed to well fluid pressure acting to urge the piston means, and slip means axially as aforesaid, and d. delay means acting to block said movement of the slip means relative to the body while well fluid pressure exerted on said piston surface extent remains below a predetermined level, and to unblock said relative movement when the well fluid pressure reaches said level whereby the pressure is then operable to effect axial movement of the slip means, e. said delay comprising a first part carried for movement with the piston means, and a second part carried by the body to block said axial movement, one of said parts being displaceable out of blocking position relative to the other part in response to force transmission between said parts when said pressure reaches said level, f. said one part comprising a cantilever mounted arm.

7. The apparatus of claim 6 wherein said arm includes adjustable leaf spring means and a backer, both of which are carried by said body.

8. The combination of claim 7 wherein said delay means also includes a shearable element.

9. In apparatus to anchor well tubing to well casing a. a tubular body connectible in series with a well tubing string, there being a wedge surface on the body and tapering axially, b. slip means movable axially relative to the body and positioned to be urged relatively radially outwardly toward the casing by the wedge surface, c. piston means carried for axial movement relative to the body, and having piston surface extent exposed to well fluid pressure acting to urge the piston means, and slip means axially as aforesaid, and d. delay means acting to block said movement of the slip means relative to the body while well fluid pressure exerted on said piston surface extent remains below a predetermined level, and to unblock said relative movement when the well fluid pressure reaches said level whereby the pressure is then operable to effect axial movement of the slip means, e. there being a carrier ring for said slip means, the carrier ring extending about the body at one end of the slip means to push the slip means axially in response to said unblocking, the piston means extending axially endwise in the body, and there being structure to transmit force from the piston means to the ring, said structure including a rod extending axially in the body.

10. In apparatus to anchor well tubing to well casing, a. a tubular body connectible in series with a well tubing string, there being a wedge surface on the body and tapering axially, b. slip means and a carrier therefor movable axially relative to the body so that the slip means is urged relatively radially outwardly toward the casing by the wedge surface, c. piston means carried for axial movement relative to the body, and having piston surface extent exposed to well fluid pressure acting to urge the piston means, carrier and slip means axially as aforesaid, d. said carrier including a ring extending about the body at one end of the slip means to push the slip means axially in response to said piston means movement, the piston means extending axially endwise in the body, and there being structure to transmit force from the piston means to the ring, said structure including a rod extending axially in the body.

11. The method of anchoring a pipe string to casing in a well and at an anchor location deep in the well, the anchor including slip means, that includes the steps, a. allowing fluid to rise in the pipe string above said location and allowing the string to correspondingly elongate downwardly in the well, and b. utilizing the static pressure of the rising fluid to cause the slip means to move upwardly, for anchoring the string to the casing at said location subsequent to said elongation, thereby to block the string against downward movement only, but allowing the string to move up in the well, c. producing upward flow of well fluid, while the string is anchored, and d. maintaining the annulus about the anchor open while said upward production flow is continued.

12. The method of claim 11 wherein said anchoring is effecting in response to fluid pressure build-up to a predetermined value at a selected point in the well.

13. The method of claim 12 wherein slip means carried by the string is caused to suddenly move bodily outwardly to engage the casing to effect said anchoring.

14. The method of claim 13 including the step of preliminarily providing a connection which effectively blocks slip means movement, and releasing said connection in response to fluid pressure build-up to said value.

* * * * *